US010849470B2

(12) United States Patent
Mann et al.

(10) Patent No.: US 10,849,470 B2
(45) Date of Patent: Dec. 1, 2020

(54) WIPES DISPENSERS AND EASY LOAD ADJUSTABLE DISPENSING NOZZLE

(71) Applicant: GOJO Industries, Inc., Akron, OH (US)

(72) Inventors: Christopher J. Mann, Hudson, OH (US); Ronald J. Hammond, Bentleyville, OH (US); Anthony J. Bachmann, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 16/211,447

(22) Filed: Dec. 6, 2018

(65) Prior Publication Data

US 2019/0183296 A1 Jun. 20, 2019

Related U.S. Application Data

(60) Provisional application No. 62/599,358, filed on Dec. 15, 2017.

(51) Int. Cl.
*A47K 10/32* (2006.01)
*A47K 10/42* (2006.01)
(Continued)

(52) U.S. Cl.
CPC ..... *A47K 10/32* (2013.01); *A47K 10/3818* (2013.01); *A47K 10/421* (2013.01); *B65D 83/0805* (2013.01); *A47K 2010/3266* (2013.01)

(58) Field of Classification Search
CPC ..... A47K 10/3818; A47K 2010/3206; A47K 2010/3233; A47K 2010/3246; Y10T 225/393
See application file for complete search history.

(56) References Cited

U.S. PATENT DOCUMENTS 4,180,160 A * 12/1979 Ogawa ..... A47K 10/3818 206/210
5,141,171 A * 8/1992 Yang ..... A47K 10/3818 206/233
(Continued)

FOREIGN PATENT DOCUMENTS

EP 3040005 7/2016
WO 9918835 4/1999

OTHER PUBLICATIONS

International Search Report from PCT/US2018/06422 dated Mar. 14, 2019 (14 pages).

*Primary Examiner* — Gene O Crawford
*Assistant Examiner* — Ayodeji T Ojofeitemi
(74) *Attorney, Agent, or Firm* — Calfee, Halter & Griswold LLP

(57) ABSTRACT

Embodiments of dispensers for dispensing wet wipes are disclosed herein. An exemplary dispenser includes a container, a plurality of wipes, and a wipes dispensing nozzle. The wipes dispensing nozzle has a first housing member and a second housing member that are movable between a first position and a second position. In the first position, the wipes dispensing nozzle has an opening that has a first diameter. In the second position, the nozzle has an opening that has a second diameter that is smaller than the first diameter. When the nozzle is in the first position, a lead wipe of the plurality of wipes may be threaded through the wipes dispensing nozzle. In the first position, the wipes dispensing nozzle does not exert sufficient frictional force against a trailing wipe to cause the lead wipe to separate from the trailing wipe along a perforation line. In the second position, the wipes nozzle is in a closed dispensing position.

20 Claims, 7 Drawing Sheets

(51) Int. Cl.
*A47K 10/38* (2006.01)
*B65D 83/08* (2006.01)

(56) References Cited

U.S. PATENT DOCUMENTS 5,215,211 A * 6/1993 Eberle ..... A47K 10/3818 221/1
5,246,137 A * 9/1993 Schutz ..... A47K 10/3818 206/409
5,263,607 A * 11/1993 Temesvary ..... A47K 10/3818 221/304
7,997,522 B2 * 8/2011 Titas ..... A47K 10/3818 221/33
8,245,876 B2 * 8/2012 Gehring ..... B65D 83/0811 221/37
8,857,614 B2 * 10/2014 Gordon ..... B65D 83/0805 206/233
9,113,760 B2 * 8/2015 Knapp ..... A47K 10/3818
9,687,125 B2 * 6/2017 Marietta-Tondin ..... A47K 10/3818
9,962,045 B2 * 5/2018 Granger ..... A47K 10/3818
10,334,996 B2 * 7/2019 Tedesco ..... A47K 10/3818
10,369,589 B2 * 8/2019 Dale ..... B05C 17/00503
2003/0111480 A1 6/2003 Lewis et al.
2006/0261076 A1 * 11/2006 Anderson ..... A47K 10/3818 221/33
2009/0120951 A1 * 5/2009 Titas ..... A47K 10/3818 221/45
2010/0264159 A1 * 10/2010 Gordon ..... A47K 10/16 221/46
2013/0306669 A1 * 11/2013 Ray ..... A47K 10/24 221/63
2015/0048105 A1 * 2/2015 Gordon ..... A47K 10/421 221/63
2018/0020887 A1 * 1/2018 Gordon ..... A47K 10/421 221/45
2018/0310782 A1 * 11/2018 Harris ..... A47K 10/3818
2019/0200818 A1 * 7/2019 Mann ..... A47K 10/424

* cited by examiner

WIPES DISPENSERS AND EASY LOAD ADJUSTABLE DISPENSING NOZZLE

RELATED APPLICATIONS

This application claims priority to and the benefits of U.S. Provisional Patent Application Ser. No. 62/599,358, titled WIPES DISPENSERS AND EASY LOAD ADJUSTABLE DISPENSING NOZZLE, and which was filed on Dec. 15, 2017, and which is incorporated by reference herein in its entirety.

TECHNICAL FIELD

The present invention generally relates to dispensers for dispensing wipes or moist towelettes. More particularly, the present invention relates to wipes dispensers having easy load adjustable dispensing nozzles and also to wipes dispensers that prevent or reduce "dry-out" of wipes located in the wipes dispenser.

BACKGROUND OF THE INVENTION

Wipes are typically made from a variety of materials, such as non-woven materials. Wipes are often moistened with solutions, such as antimicrobial solutions. The wipes may be stacked and folded in a container or may be in the form of a roll. Wipes in the form of a roll typically have perforations between the wipes that are strong enough to remain attached to one another so that the top of the trailing or trailing wipe is pulled up through a dispensing outlet nozzle prior to the perforations tearing away and allowing the leading wipe to be used and leaving a lead tail extending out of the outlet nozzle. Accordingly, the lead tail of the trailing wipe may be grabbed by a user and pulled out of the container. Often, however, the lead tail does not extend high enough past the opening for a user to grab, which leads to customer "short tail" complaints. Similarly, "fall back" complaints occur when the wipe falls back through the outlet nozzle and into the container. It is typically difficult to thread wipes through the wipes nozzle and it is annoying when fall back occurs, a short tail occurs, or when it is time to install a new roll of wipes the dispenser. Furthermore, many of the current wipe nozzles require a tool to rethread the wipes. In addition, may current wipes dispensers include openings through slits or cutouts that allow fluid in the wipes/container to evaporate and cause the wipes to "dry-out."

SUMMARY

Embodiments of dispensers for dispensing wet wipes are disclosed herein. An exemplary dispenser for dispensing wipes includes a container, a plurality of wipes contained within the container and a wipes dispensing nozzle. The wipes dispensing nozzle has a first housing member and a second housing member that are movable between a first position and a second position. In the first position the wipes dispensing nozzle has an opening that has a first diameter. In the second position, the wipes dispensing nozzle has an opening that has a second diameter. The second diameter is smaller than the first diameter. When the nozzle is in the first position, a lead wipe of the plurality of wipes may be threaded through the wipes dispensing nozzle. In the first position, the wipes dispensing nozzle does not exert sufficient frictional force against a trailing wipe to cause the lead wipe to separate from the trailing wipe along a perforation line.

Another exemplary dispenser for dispensing wipes includes a container, a plurality of wipes contained within the container and a wipes dispensing nozzle. The wipes dispensing nozzle has a first housing member, a second housing member and a flexible sleeve. The wipes dispensing nozzle is movable between a first position and a second position. In the first position, the wipes dispensing nozzle has an opening formed by the flexible sleeve having a first diameter. In the second position, the wipes dispensing nozzle has an opening formed by the flexible sleeve having a second diameter. The second diameter is smaller than the first diameter. In the first position, a wipe may be threaded through the opening and the opening is large enough that it does not exert sufficient frictional on a trailing wipe to cause the lead wipe to separate from the trailing wipe along a perforation line.

An exemplary methodology of loading a wipes dispenser nozzle includes obtaining a container of wipes having an easy load adjustable nozzle and placing the easy load adjustable nozzle in an open loading position. The open loading position does not exert sufficient force to cause a lead wipe to separate from a trailing wipe. The exemplary methodology further includes threading a lead wipe through the easy load adjustable nozzle and placing the adjustable dispensing nozzle in a closed dispensing position.

Another exemplary dispenser for dispensing wipes includes a container, a plurality of wipes contained within the container and a wipes dispensing nozzle. The wipes dispensing nozzle has a first housing member, a second housing member and a valve. The wipes dispensing nozzle is movable between a first position and a second position. In the first position, the valve has an opening that has a first diameter. In the second position, the valve has an opening that has a second diameter. The second diameter is smaller than the first diameter.

Exemplary embodiments of wipes dispensing nozzles are also disclosed herein. An exemplary embodiment has a first housing member, a second housing member and a flexible sleeve. The wipes dispensing nozzle is movable between a first position and a second position. In the first position, the wipes dispensing nozzle has an opening formed by the flexible sleeve having a first diameter. In the second position, the wipes dispensing nozzle has an opening formed by the flexible sleeve that has a second diameter. The second diameter is smaller than the first diameter.

Another exemplary wipes dispensing nozzle has a first housing member and a second housing member that are movable between a first position and a second position. In the first position, the wipes dispensing nozzle has an opening that has a first diameter. In the second position, the wipes dispensing nozzle has an opening that has a second diameter. The second diameter is smaller than the first diameter. When the nozzle is in the first position, a lead wipe of the plurality of wipes may be threaded through the wipes dispensing nozzle. The wipes dispensing nozzle does not exert sufficient frictional force against a trailing wipe to cause the lead wipe to separate from the trailing wipe along a perforation line when it is in the open loading position.

Another exemplary wipes dispensing nozzle has a first housing member, a second housing member and a shutter. The wipes dispensing nozzle is movable between a first position and a second position. In the first position, the wipes dispensing nozzle has an opening formed by the shutter that has a first diameter. In the second position, the wipes dispensing nozzle has an opening formed by the shutter having a second diameter that is smaller than the first diameter.

Another exemplary wipes dispensing nozzle has a first housing member, a second housing member and a valve. The wipes dispensing nozzle is movable between a first position and a second position. In the first position, the wipes dispensing nozzle has an opening formed by the valve that has a first diameter. In the second position, the wipes dispensing nozzle has an opening formed by the flexible sleeve that has a second diameter that is smaller than the first diameter.

BRIEF DESCRIPTION OF THE DRAWINGS

These and other features and advantages of the present invention will become better understood with regard to the following description, and accompanying drawings where.

DETAILED DESCRIPTION

Figure 1:
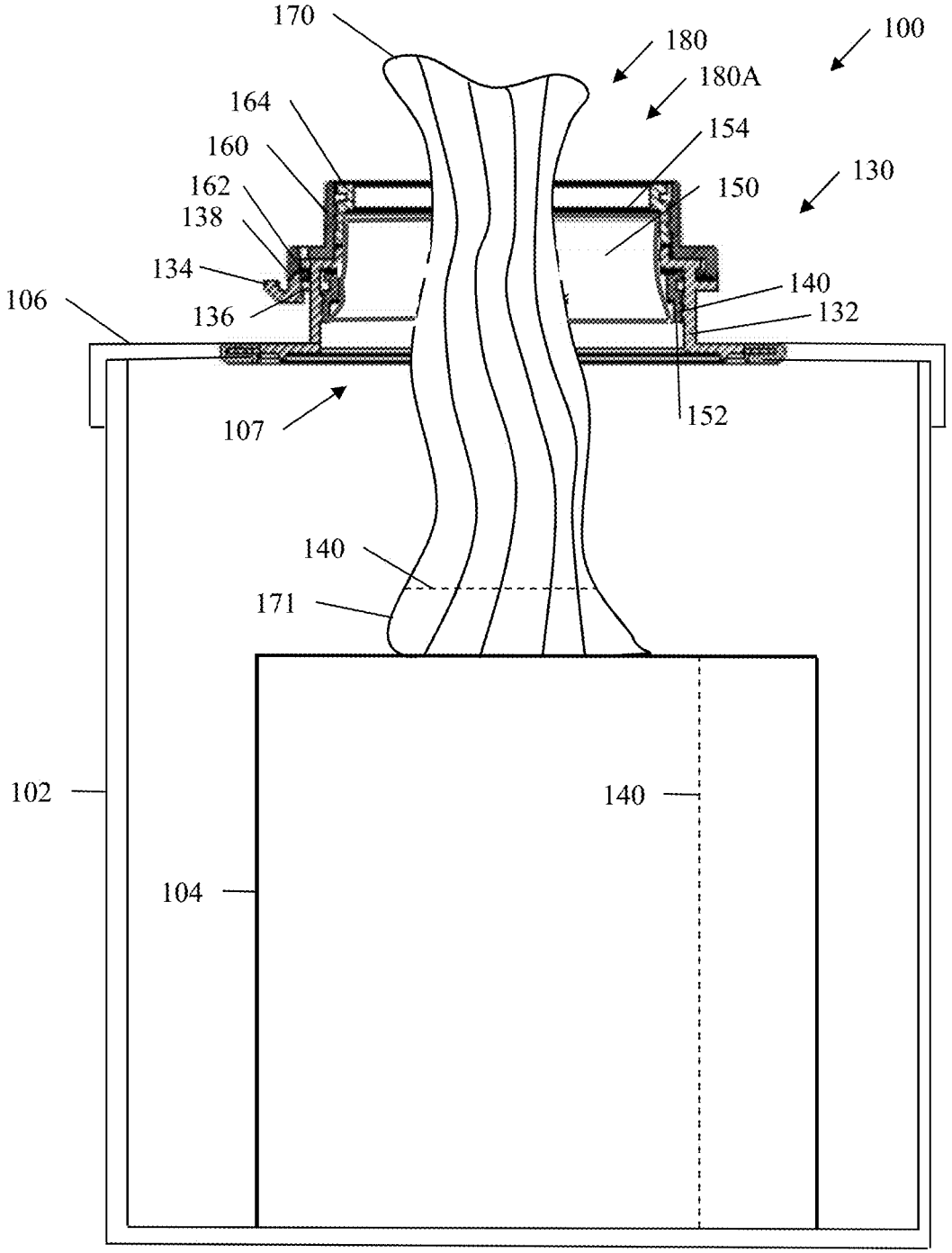
FIG. 1 is a cross-sectional view of an exemplary wipes dispenser having an easy load adjustable nozzle with the nozzle in an open loading position with a lead wipe pulled through the easy load adjustable nozzle.
Figure 2:
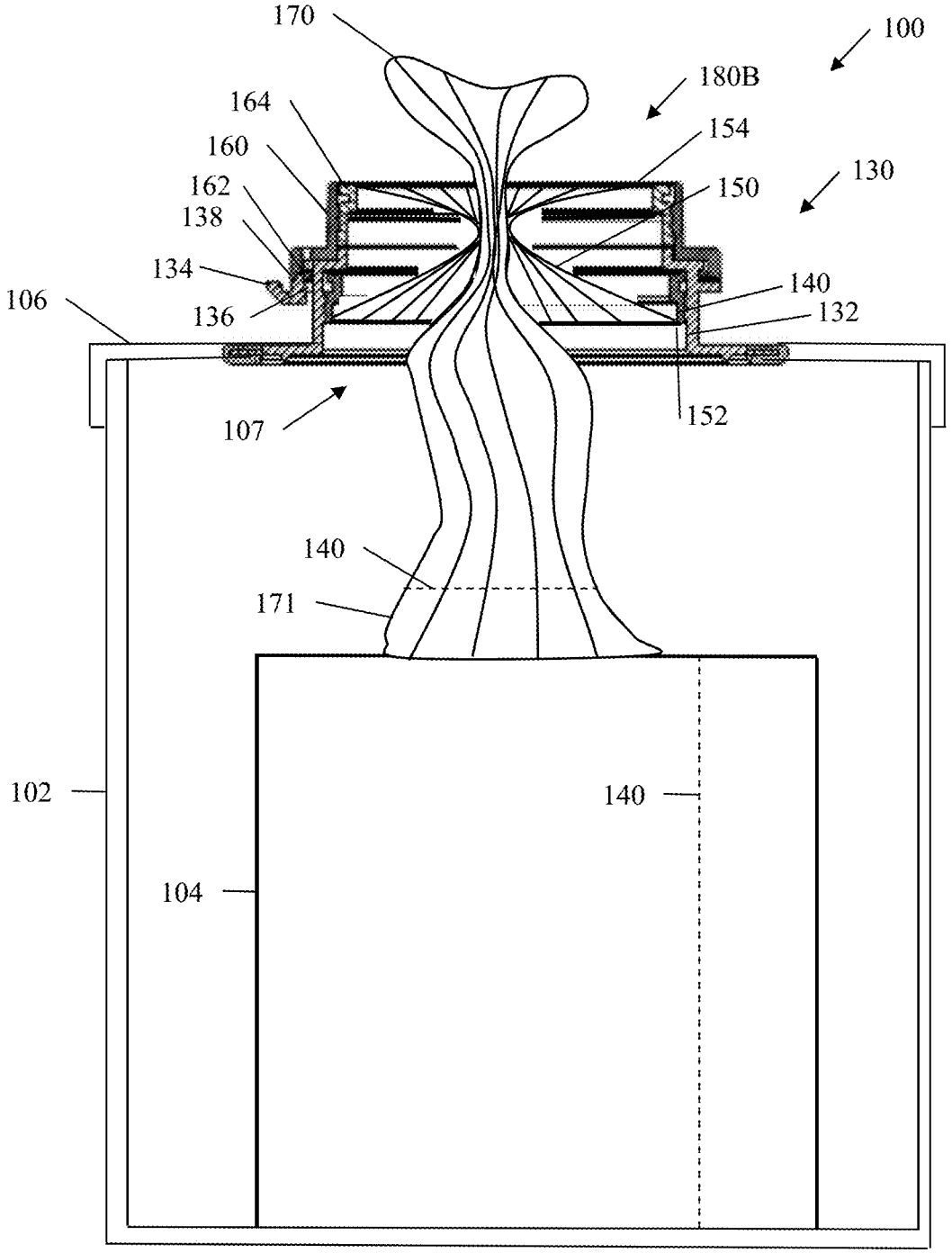
FIG. 2 is a cross-sectional view of the exemplary wipes dispenser having an easy load adjustable nozzle of FIG. 1 with the nozzle in a closed dispensing position with a lead wipe pulled through the easy load adjustable nozzle.

FIGS. 1 and 2 illustrate an exemplary embodiment of a wipes dispenser 100 having an easy load adjustable nozzle 130. Wipes dispenser 100 includes a container 102. Located inside of container 102 is a roll of wipes 104. The roll of wipes 104 are moistened with a fluid. The fluid may be completely absorbed by the wipes. In some embodiments, there is residual fluid (not shown) in the bottom of the container. Fluid in the bottom of the container may travel up the wipes through a wicking motion. The role of wipes 104 has periodic perforations 140 that are used to separate individual wipes from the role of wipes 104. In some embodiments, the wipes are not in a roll, but may rather be individual wipes that are folded together such that the leading wipe pulls the trailing wipe through the opening before the two wipes separate. Wipes dispenser 100 includes a cap 106 secured to container 102. Cap 106 may be secured to container 102 by any means such as, for example, a threaded connection, a welded connection, a snap-fit connection, an adhesive bonding connection, a friction fit, or the like.

Easy load adjustable nozzle 130 is connected to cap 106. In some embodiments, easy load adjustable nozzle 130 and cap 106 are integrated into a single unit. Easy load adjustable nozzle 130 includes a first (or upper) housing member 160 and a second (or lower) housing member 132. First and second housing members 160, 132 are connected in a manner that allows first housing member 160 to be moved in relation to second housing member 132. In this exemplary embodiment, first housing member 160 rotates with respect to second housing member 132.

Opening 107 is formed at least in part by lower housing member 132. Lower hosing member 132 has a cylindrical shape and includes a ratchet catch mechanism 138 and release tab 134. Upper housing member 160 has a cylindrical shape and has ratchet members 162 located around it that engage the ratchet catch mechanism 138. In this exemplary embodiment, pushing down on release tab 134 causes ratchet catch mechanism 138 to disengage with the ratchet members 162 that are located on a portion of upper housing 164.

Easy load adjustable nozzle 130 also includes a lower retaining ring 140 and an upper retaining ring 164. Lower retaining ring 140 connects the lower end 152 of flexible sleeve 150 to lower housing member 132. Upper retaining ring secures the upper end 154 of flexible sleeve 150 to upper housing member. Flexible sleeve 150 may be any type of flexible material that is capable of forming the open loading configuration and the closed dispensing configuration described herein, such as, for example, plastic, rubber, elastomer, silicone, urethane, polyvinyl chloride ("PVC"), fabric, hydrophobic fabric, carbon fibers, and the like; and combinations thereof. In some embodiments, the flexible material is capable of stretching.

Rotation of upper housing 160 with respect to lower housing 132 causes flexible sleeve 150 to stretch or collapse across the opening 180 and reduce the size of opening 180. Opening 180A, shown in FIG. 1, is an example of an open loading position. In the open loading position, the diameter of the opening 180A is larger than the opening 180B in the closed dispensing position. The opening 180 in the loading position is large enough to easily thread a wipe 170 up through the opening 180 in the open or loading position 180A and does not exert enough force on the wipe 170 to cause a trailing wipe 171 to separate from the leading wipe 170.

In this embodiment, ratchet members 162 extend around a circumference of upper housing member 164. This allows upper housing 160 to be rotated to any specific position with respect to lower housing member 132 and remain in that position until ratchet catch mechanism 138 is released. In some embodiments, ratchet catch mechanism 138 has an angled surface so that upper housing 160 may be rotated towards its closed dispensing position 180B without manually releasing ratchet catch mechanism 138. In some embodiments, ratchet members 162 extend only partially around upper housing 160. In this way, the minimum diameter of the opening in the closed dispensing position is controlled by the location of the ratchet members 162. In some embodiments, a stop member (not shown) is used to prevent the opening 180 in the closed dispensing position from being too small.

Opening 180 has a first diameter (FIG. 1) which is the open loading position 180A. As can be seen in FIG. 1, the opening is substantially larger than the lead wipe 170 that is pulled up through the easy load adjustable nozzle 130. This allows the lead wipe 170 to be threaded through the nozzle 130 very easily without the need for a tool to push or pull the wipe through the nozzle 130 as is typically required in prior art nozzles. In some embodiments, in the open loading position 180A, the lead wipe 170 will fall back through the nozzle 130 if one lets go of the end of the wipe 140. In other words, the opening 180 in the open loading position 180A does not grip the wipe 170 or put significant frictional forces on the wipe 170. That is, any frictional force applied to the wipe 170 by the easy load adjustable nozzle 130, will not cause the wipe 140 to separate from the roll of wipes 104 along perforations 140 when the wipe is pulled upward.

Figure 7:
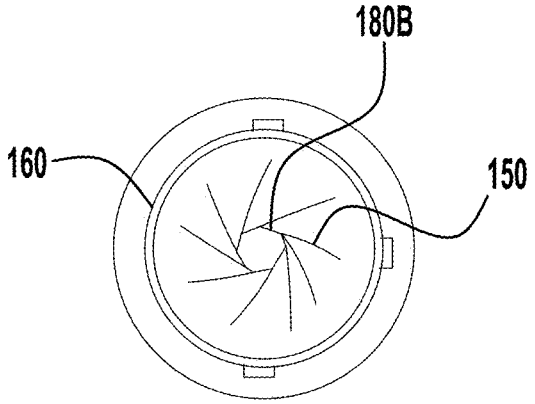
FIG. 7 is a plan view of the exemplary easy load adjustable nozzle in a closed or dispensing position without a wipe extending therethrough.
Figure 8:
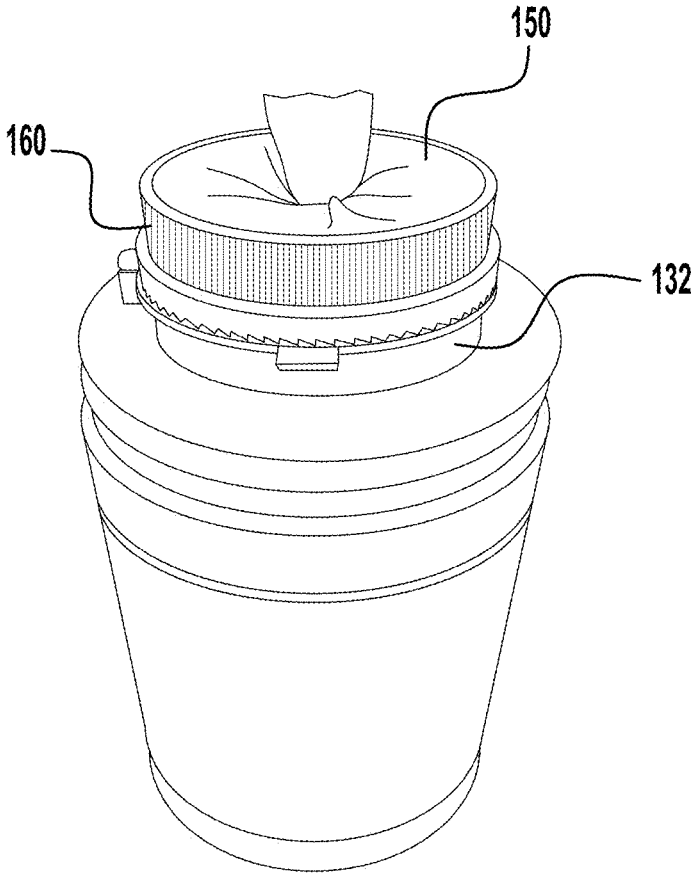
FIG. 8 is a prospective view of an exemplary wipes dispenser with an easy load adjustable nozzle.

FIGS. 2, 7 and 8 illustrate the easy load adjustable nozzle 130 having a smaller opening 180 and is in the closed or dispensing position180B. The smaller opening 180 secures the wipe 170 and prevents (or reduces) fluid (not shown) from evaporating out to the container 102. In addition, the smaller opening 180 causes enough frictional force on the wipes 170, 171 so that the lead wipe 170 is separated from the trailing wipe 171 when the perforation 140 between the lead wipe 170 and trailing wipe 171 are slightly above the top of the smaller opening 180 in the dispensing or closed position180B. The diameter of the opening 180 in the closed dispensing position 180B is a function of the particular wipes 170, 171 being dispensed and an optimal frictional force that results in the lead end of the trailing wipe 171 separating from the lead wipe 170 after a sufficient amount of the trailing wipe 171 extends out of the end of the easy load adjustable dispensing nozzle.

Figure 3:
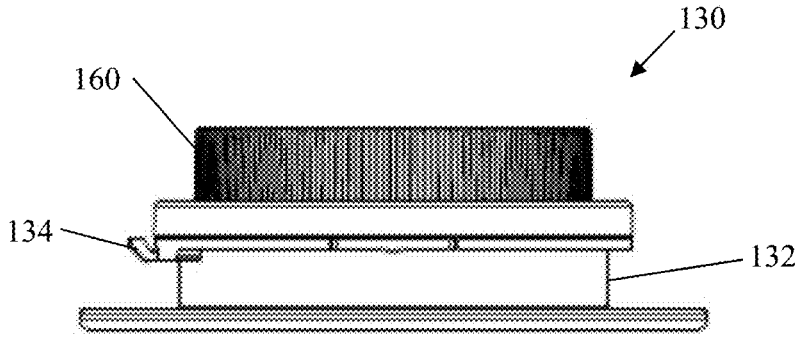
FIG. 3 is a side elevational view of the exemplary easy load adjustable nozzle of FIG. 1.
Figure 4:
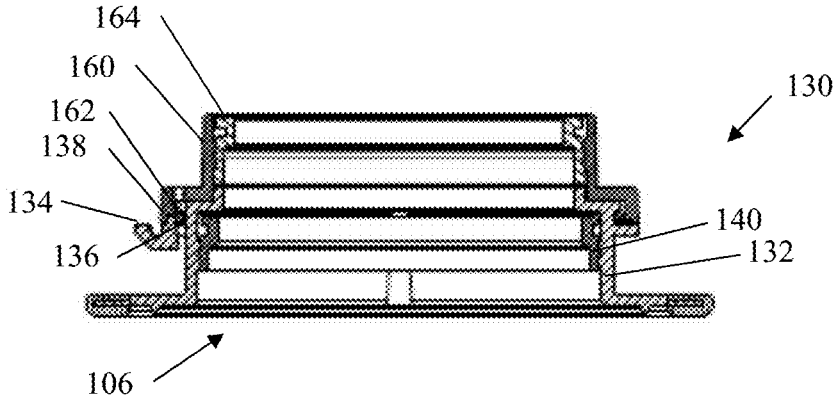
FIG. 4 is a cross-sectional view of the exemplary easy load adjustable nozzle of FIG. 1 without the flexible sleeve.
Figure 5:
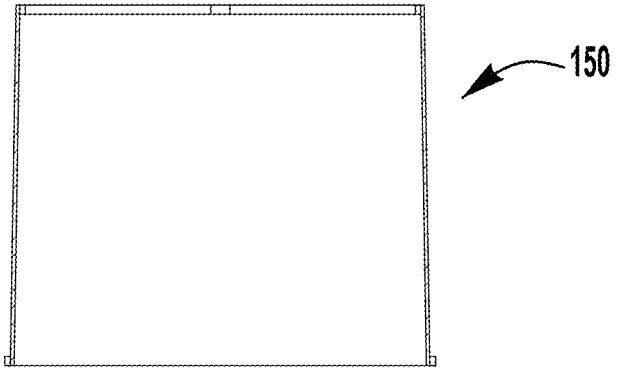
FIG. 5 is a cross-section of an exemplary flexible sleeve.
Figure 6:
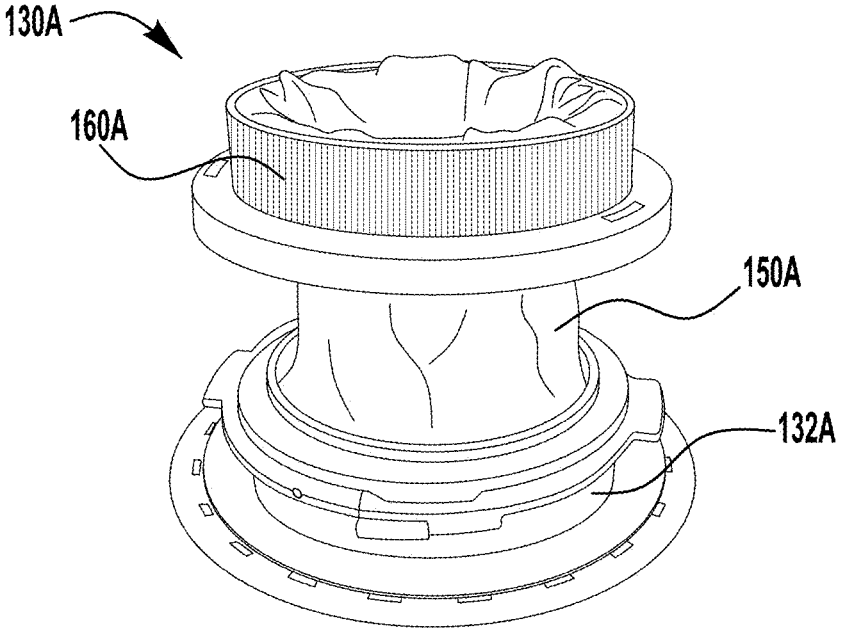
FIG. 6 is a partially view of the easy load adjustable nozzle.

FIG. 3 is a side elevational view of the exemplary easy load adjustable dispensing nozzle 130 and FIG. 4 is a cross-section thereof. FIG. 5 is a cross-sectional view of an exemplary sleeve 150 and FIG. 6 is a partially exploded prospective view a dispensing nozzle 130A having an upper housing 160A, a lower housing 132A and a sleeve 150A. In this embodiment, upper housing member 160A is separated from lower housing member 132A for illustrative purposes, however, in practice they are connected together as shown above.

FIG. 7 is a plan view of the easy load adjustable nozzle 130 in the closed position having an opening 180 that is in a closed dispensing position 180B. in the closed dispensing position 180B, the opening 180 exerts pressure on the wipe 170 and creates seal that helps prevent dry-out of the wipe 170 that is located below the opening 180. FIG. 8 is a prospective view of the wipes dispenser 100 having an easy load adjustable nozzle 130.

Figure 9:
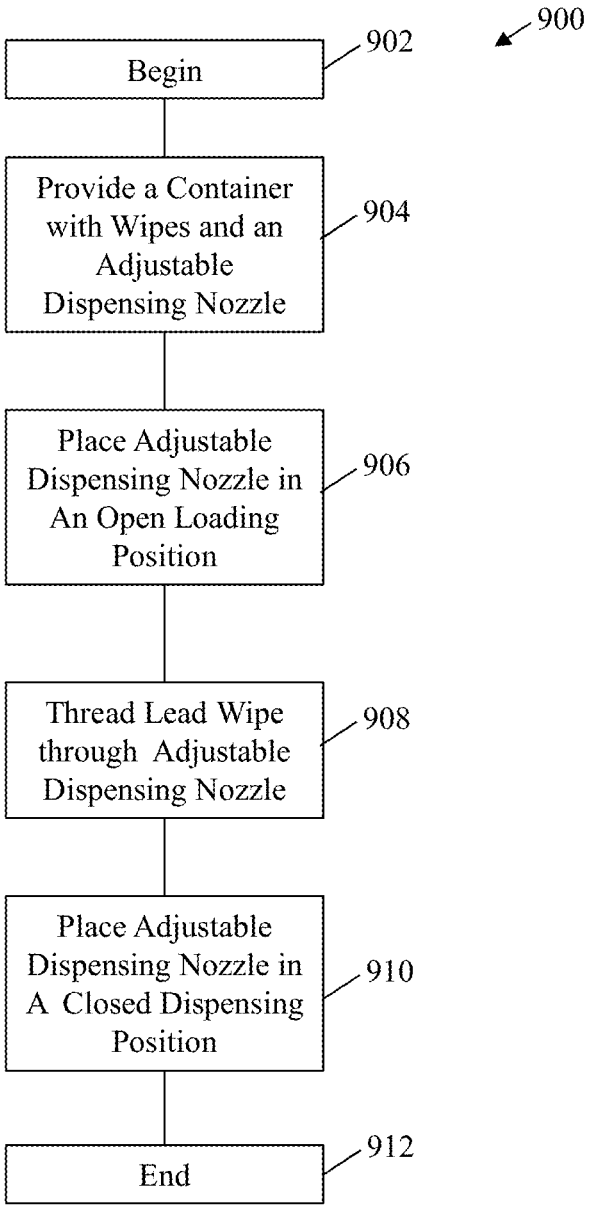
FIG. 9 is an exemplary methodology for loading a wipe in an easy load adjustable nozzle.

FIG. 9 is an exemplary methodology 900 for threading a lead wipe of a roll of wipes. The methodology begins at block 902 and at block 904 a container with wipes and an easy load adjustable dispensing nozzle is provided. At block 906 the adjustable dispensing nozzle is placed in an open loading position. This may be accomplished by, for example, releasing a ratchet catch and rotating a member with respect to another member to open the nozzle.

A lead wipe is threaded through the opening in the nozzle. In the open loading position, the wipe may fall back into the container if it is released. In addition, in this position, there is insufficient frictional forces exerted by the easy load adjustable nozzle to cause the lead wipe to separate from the trailing wipe along perforation lines if the lead wipe is pulled through the easy load adjustable nozzle.

At block 910 the easy load adjustable nozzle is placed in its closed dispensing position. This may be accomplished by, for example, rotating a member with respect to another member to close the opening around the wipe and place the nozzle in the closed dispensing position. In the closed dispensing position, pulling on the lead wipe will result in the trailing wipe extending partially through the nozzle prior to separating from the lead wipe. The methodology ends at block 912

Figure 10A:
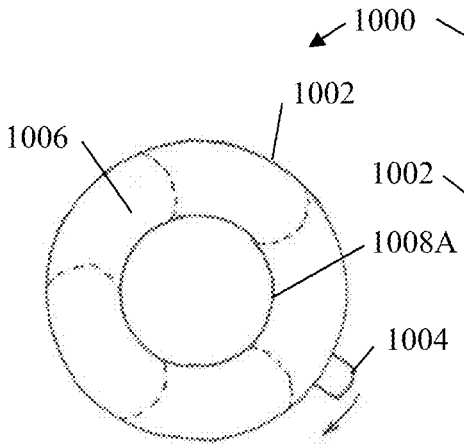
FIGS. 10A and 10B are an exemplary embodiment of an easy load adjustable nozzle having a shutter type closure.
Figure 10B:
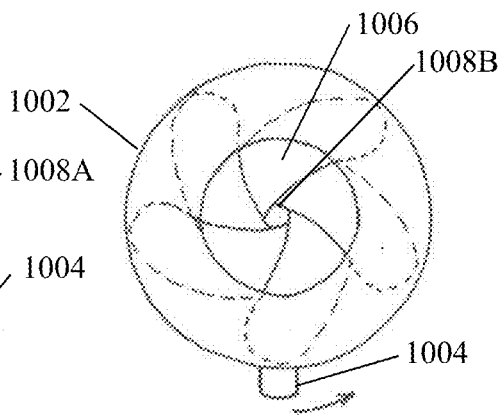

Another exemplary embodiment utilizes a shutter style closure 1000 (shown in FIGS. 10A and 10B) to achieve perform similar functions to those described above. In some embodiments, the shutter style closure appears similar in appearance to that of a camera shutter. In this embodiment, the shutter 1006 has an open loading position that has a first diameter 1008A that allows a wipe to be easily threaded up through the nozzle 1000. Again, when the nozzle 1000 is in the open loading position, pulling the lead wipe up through the nozzle will not result in the lead wipe separating from the roll of wipes. After the lead wipe is pulled up through the nozzle, the shutter 1006 is moved to its closed dispensing position 1008B. In this position, the shutter exerts frictional forces on the wipes as the wipes are pulled through the nozzle. The frictional force is sufficient that when the lead wipe is pulled out of the container, the trailing wipe separates from the perforation line, once the perforation line is sufficiently above the easy load adjustable nozzle. In this exemplary embodiment, the easy load adjustable nozzle 1000 has a first housing member 1002 and a second housing member 1004 that move with respect to one another to move between the open loading position 1008A and the closed dispensing position 1008B by rotating one with respect to the other as described above and may include similar ratchet members and one or more ratchet catch members.

Figure 11A:
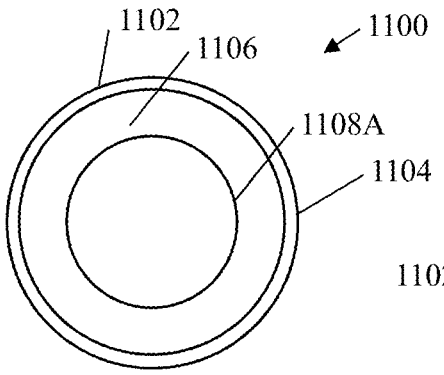
FIGS. 11A and 11B are an exemplary embodiment of an easy load adjustable nozzle having a valve type closure.
Figure 11B:
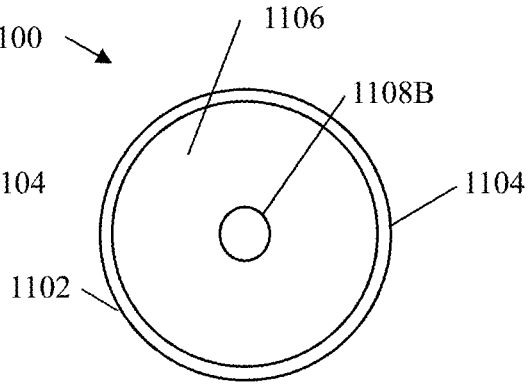

Another exemplary embodiment utilizes a shutter style closure 1100 (shown in FIGS. 11A and 11B) to achieve and/or perform similar functions to those described above. In some embodiments, the valve style closure is used to achieve and/or perform similar functions. In this embodiment, the valve 1106 has an open loading position that has a first diameter 1108A that allows a wipe to be easily threaded up through the nozzle 1100. Again, when the nozzle 1100 is in the open loading position, pulling the lead wipe up through the nozzle will not result in the lead wipe separating from the roll of wipes. After the lead wipe is pulled up through the nozzle, the valve 1106 is moved to its closed dispensing position 1108B. In this position, the valve exerts frictional forces on the wipes as the wipes are pulled through the nozzle 1100. The frictional force is sufficient that when the lead wipe is pulled out of the container, the trailing wipe separates from the lead wipe along a perforation line, once the perforation line is sufficiently above the easy load adjustable nozzle 1100. In this exemplary embodiment, the easy load adjustable nozzle 1100 has a first housing member 1102 and a second housing member 1104 that move with respect to one another to move between the open loading position 1108A and the closed dispensing position 1108B by rotating one with respect to the other as described above and may include similar ratchet members and one or more ratchet catch members.

In some embodiments, caps shown and disclosed herein may include a cover (not shown), such as, for example, a snap cover.

Many of the exemplary embodiments eliminate or reduce "dry-out" by at least partially forming a seal around the wipe. At least partially forming a seal around the wipe prevents or reduces the amount of evaporation of the fluid out of the container.

In some embodiments, the nozzles described herein may be used in any type of container. The containers contain a fluid for wetting the wipes. In some embodiments, the fluid is a sanitizer. In some embodiments, the fluid contains one or more antimicrobials. In some embodiments, the fluid is a disinfectant. In some embodiments, the fluid includes an alcohol. In some embodiments, the fluid includes ethanol. In some embodiments, the fluid includes isopropyl alcohol. In some embodiments, the fluid includes denatured ethanol. In some embodiments, the fluid includes a quaternary ammonium cation or salt. In some embodiments, the fluid includes a bleach.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the fluid retaining member may be separate from the dome swivel nozzle. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A dispenser for dispensing wipes comprising:
a container;
a plurality of wipes contained within the container;
a wipes dispensing nozzle;
wherein the wipes dispensing nozzle has a first housing member and a second housing member that are separate from one another and are movable with respect to one another between a first position and a second position;
wherein in the first position the wipes dispensing nozzle has an opening having a first diameter;
wherein in the second position, the wipes dispensing nozzle has an opening having a second diameter;
wherein the second diameter is smaller than the first diameter.

2. The dispenser of claim 1 wherein one of the first and second housing members comprises ratchet members and the other of the first and second housing members comprise a ratchet catch mechanism.

3. The dispenser of claim 1 further comprising a shutter assembly, wherein movement between the first housing member and the second housing member causes the shutter assembly to open and wherein movement of the shutter assembly in a second direction causes the shutter assembly to close.

4. The dispenser of claim 1 further comprising a valve assembly, wherein movement between the first housing member and the second housing member causes the valve assembly to open and wherein movement of the valve assembly in a second direction causes the valve assembly to close.

5. The dispenser of claim 1 wherein the plurality of wipes are a roll of wipes.

6. The dispenser of claim 1 wherein when the nozzle is in the first position, a lead wipe of the plurality of wipes may be threaded through the wipes dispensing nozzle; and
wherein when the lead wipe is threaded through the wipes dispensing nozzle, the wipes dispensing nozzle does not exert sufficient frictional force against a trailing wipe to cause the lead wipe to separate from the trailing wipe along a perforation line.

7. The dispenser of claim 1 further comprising a flexible sleeve.

8. The dispenser of claim 7 wherein rotation in a first direction between the first and second housings causes a portion of the flexible sleeve to rotate and causes the flexible sleeve to collapse to form the opening having the second diameter.

9. The dispenser of claim 7 further comprising an upper retaining ring for connecting an upper portion of the sleeve to the first housing and a lower retaining ring for connecting a lower portion of the support sleeve to the second housing member.

10. A dispenser for dispensing wipes comprising:
a container;
a plurality of wipes contained within the container;
a wipes dispensing nozzle;
the wipes dispensing nozzle having a first housing member, a second housing member and a flexible sleeve;
wherein the wipes dispensing nozzle is movable between a first position and a second position;
wherein in the first position the wipes dispensing nozzle has an opening formed by the flexible sleeve having a first diameter;
wherein in the second position, the wipes dispensing nozzle has an opening formed by the flexible sleeve having a second diameter;
wherein the second diameter is smaller than the first diameter;
wherein in the first position a wipe may be threaded through the opening and the opening is large enough that it does not exert sufficient frictional on a trailing wipe to cause the lead wipe to separate from the trailing wipe along a perforation line.

11. The dispenser of claim 10 wherein one of the first housing member and the second housing member has ratchet members and wherein the other of the first and second housing member has a ratchet catch member.

12. The dispenser of claim 10 wherein one of the first housing member and the second housing member rotate with respect to one another.

13. The dispenser of claim 10 further comprise an upper retaining ring for retaining an upper portion of the sleeve to the first housing member.

14. The dispenser of claim 10 further comprise a lower retaining ring for retaining a lower portion of the sleeve to the second housing member.

15. The dispenser of claim 10 further comprising a roll of wipes.

16. A method of loading a wipes dispenser nozzle comprising:
obtaining a container of wipes having an easy load adjustable nozzle;
placing the easy load adjustable nozzle in an open loading position;
wherein the open loading position does not exert sufficient force to cause a leading wipe to separate from a trailing wipe;
threading a leading wipe through the easy load adjustable nozzle;
placing the adjustable dispensing nozzle in a closed dispensing position.

17. The method of claim 16 wherein the easy load adjustable nozzle is moved to the open loading position and closed dispensing position by rotation of a first portion relative to a second portion.

18. The method of claim 16 wherein the easy load adjustable nozzle contains a flexible sleeve that is rotated between the open loading position and the closed dispensing position.

19. The method of claim 16 wherein the easy load adjustable nozzle contains a shutter that is rotated between the open loading position and the closed dispensing position.

20. The method of claim 16 wherein in the closed dispensing position, the dispenser reduces drying out of the wipes located within the container by at least partially forming a seal around a wipe.

* * * * *